United States Patent [19]

Mol et al.

[11] 4,000,889

[45] Jan. 4, 1977

[54] CAM-OPERATED PHASING MECHANISM FOR A COLLATOR

[75] Inventors: Hans C. Mol, Wilton; Leroy H. Byrne, Waterbury; Arnold Fassman, Westport, all of Conn.

[73] Assignee: Pitney-Bowes, Inc., Stamford, Conn.

[22] Filed: Oct. 6, 1975

[21] Appl. No. 619,652

[52] U.S. Cl. ..... 270/58

[51] Int. Cl.[2] ..... B65H 32/045

[58] Field of Search ..... 270/58–60; 271/64, 173

[56] References Cited

UNITED STATES PATENTS

| | | | |
|---|---|---|---|
| 2,089,861 | 8/1937 | Schlensker | 270/58 |
| 2,940,750 | 6/1960 | Mestre | 270/58 |
| 3,540,721 | 11/1970 | Blowsky | 270/58 |

*Primary Examiner*—Edgar S. Burr
*Assistant Examiner*—A. Heinz
*Attorney, Agent, or Firm*—William D. Soltow, Jr.; Albert W. Scribner; Robert S. Salzman

[57] ABSTRACT

A cam operated phasing mechanism for a rotary drum collator is described. The rotary drum collator comprises a rotatably mounted drum having pockets for holding sheet material, and an adjacently rotatably mounted withdrawing mechanism for withdrawing sheets from the pockets as the drum and the withdrawing mechanism rotate in a predetermined phase relationship. The predetermined phase relationship between the rotation of the drum and the rotation of the withdrawing mechanism is varied in order to change the phase relationship to accommodate for the depletion of the sheet material from the individual pockets. The change in phase relationship is accomplished by a dual surface cam and double cam follower combination which provides for a simultaneous unitized increase and decrease in corresponding effective working lengths of a drive chain interconnected between the drum and the withdrawing mechanism. This construction provides for a positive increase and decrease in the working lengths of the chain in order to eliminate backlash in an otherwise free system, and eliminates the need for spring-loading any portion of the drive chain which would otherwise not be positively controlled with respect to changes in the aforementioned effected working lengths.

6 Claims, 11 Drawing Figures

FIG. 1
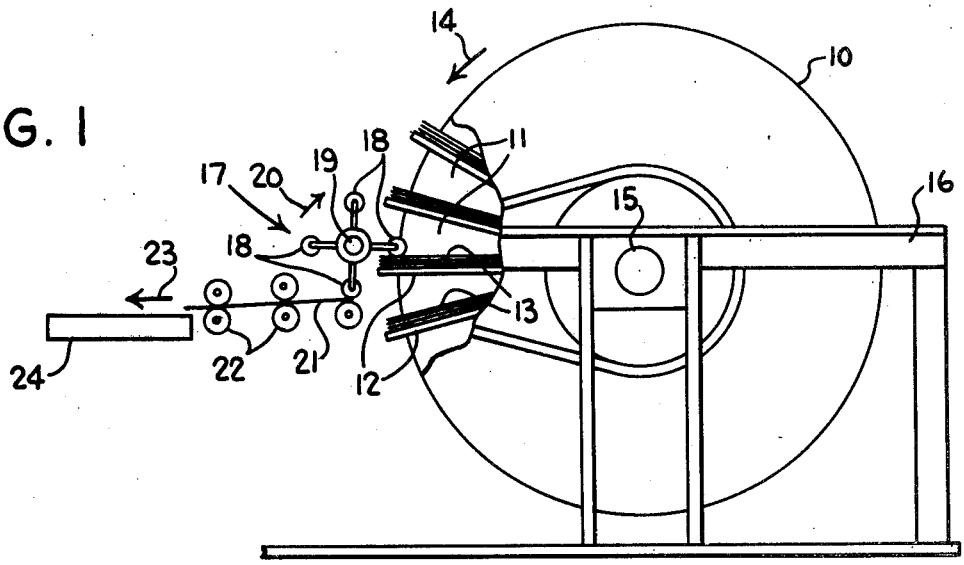
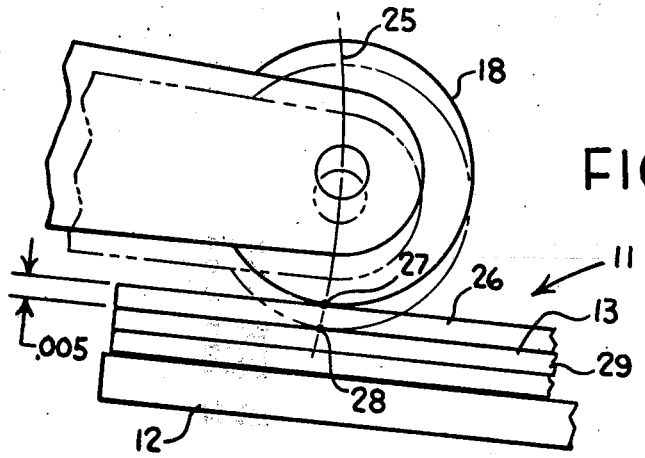
FIG. 1a
FIG. 1b
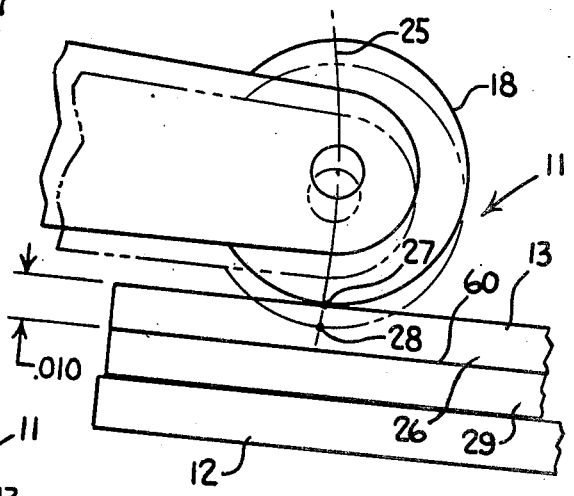
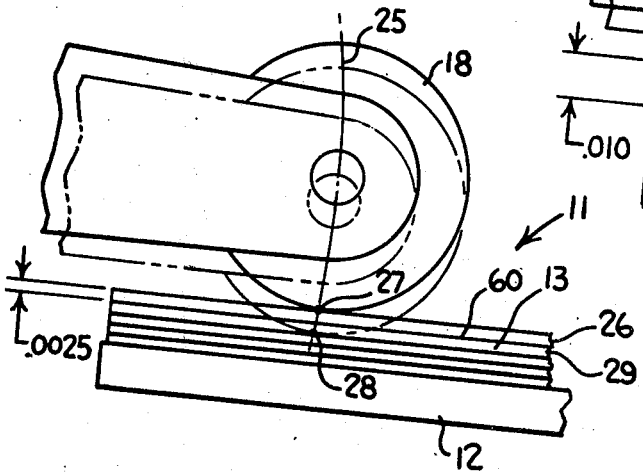
FIG. 1c

CAM-OPERATED PHASING MECHANISM FOR A COLLATOR

The invention pertains to collating machinery, and more particularly to adjusting devices for insuring and maintaining the proper timing or phase relationships of interdigitating apparatuses of a rotary drum collator.

BACKGROUND OF THE INVENTION

Recently, a rotary drum collator has been invented that provides a much higher speed of collation. The present invention is an improvement on the collator disclosed in patent application Ser. No. 410,900 filed Oct. 29, 1973; now U.S. Pat. No. 3,970,297.

It naturally occurs that timing, phase and angle relationships between interdigitating parts of the collator are very critical. The inventive collator as described in the above application, features a rotary drum having a series of pockets for storing sheet material. The sheets are removed from the pockets to provide collations. The removal of the sheets is accomplished by rotating withdrawing arms that sweep into the rotating pockets of the drum, and frictionally remove the sheets therein disposed.

As the sheet material becomes depleted, the phase or timing angle of the rotating arms must adjust to the changing contact point for the sheets. Heretofore, a timing chain drive has provided the proper advancement of the phasing of the rotative withdrawing arms with respect to the remaining material in the drum. It has been discovered, however, that this timing chain drive only operates in the intended manner, when a standard sheet material thickness is employed. Material of a different sheet thickness is depleted from the pockets of the drum at a different rate. That is to say, that the depth or level to which the remaining material will fall within each pocket will depend upon the thickness of the sheet, i.e. the removal of a quantity of thicker material will provide a lower level of remaining material within each drum pocket, than the removal of an equal number of thinner sheets. The depth of the remaining sheet material is important to the operability of the device, because the contact point of the remaining material with the rotative arms will change as the material is depleted. Therefore, if the sheet level falls faster or slower than those standard sheet thickness for which it is designed, the collating device will eventually fail to properly operate. In other words, the rotative withdrawing arms will quickly go out of contact synchronization with the drum material.

The invention therefore, contemplates providing a sheet thickness control. This control adjusts the advancing of the phase of the withdrawing arms to allow for a greater or lesser depletion level of the remaining sheets throughout the drum.

SUMMARY OF THE INVENTION

The invention relates to a paper thickness adjustment for a rotary drum collator. A dial is provided for selecting the thickness of the sheet material which has been deposited throughout all the drum pockets. This dial controls the throw of a crank by changing positions of a cam. A crank arm for advancing the withdrawing arm phase angle. The higher the cam position, the shorter the throw of the crank arm, and the smaller the advancement of the phase angle. In other words, the cam acts as a stop or a limiting abutment to the full swing of the crank arm. For thicker material, the dial sets the cam to a lower position, so that the crank arm has a longer throw. This provides a higher rate of advancement for the phase angles of the withdrawing arms. Thus, the withdrawing arms will reach a lower contact point in order to accommodate for a lower depth of the remaining material in the pockets of the drum.

Conversely, a dial setting for thinner material will cause a higher cam position. This higher position will reduce the throw of the crank arm, thus reducing the advancement of the phase angle of the withdrawing arms.

It should be understood, that any selected sheet thickness remains the same throughout the drum. Sheet thickness cannot be varied from pocket to pocket within the drum.

It is an object of this invention to provide an improved collator mechanism for a high speed rotary drum collator;

It is another object of the invention to provide an improved phase adjustment for a high speed rotary drum collator;

It is a further object of this invention to provide a paper thickness adjustment for the advancing mechanism of a high speed rotary drum collator.

These and other objects of the invention will become more apparent and will be better understood with reference to the following detailed description taken in conjunction with the attached drawings, in which:

FIG. 1 is a schematic view of a rotary drum collator making use of the present invention;

FIGS. 1*a*, 1*b*, and 1*c* are schematic enlarged views of the withdrawing roller and the drum pockets of the collator of FIG. 1; FIG. 1*a* showing a standard sheet thickness for sheets in a stack of sheets in the drum pockets; FIG. 1*b* illustrating an over-sized thickness for the sheets in a stack of sheets in the drum pockets; and FIG. 1*c* depicting an undersized thickness for the sheets in a stack of sheets in the drum pockets;

FIG. 1*d* is a perspective view of the rotary drum collator of FIG. 1;

Figure 3A:
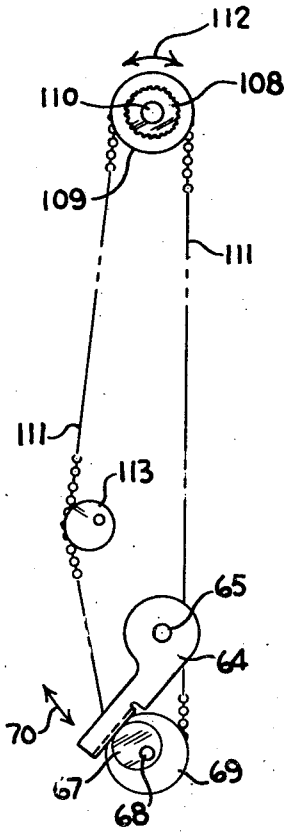
FIG. 3 is a plan view of the invention showing the advancement drive chain mechanism at the end of a collating cycle, with the advancement adjustment mechanism shown partially cut-away.
Figure 3:
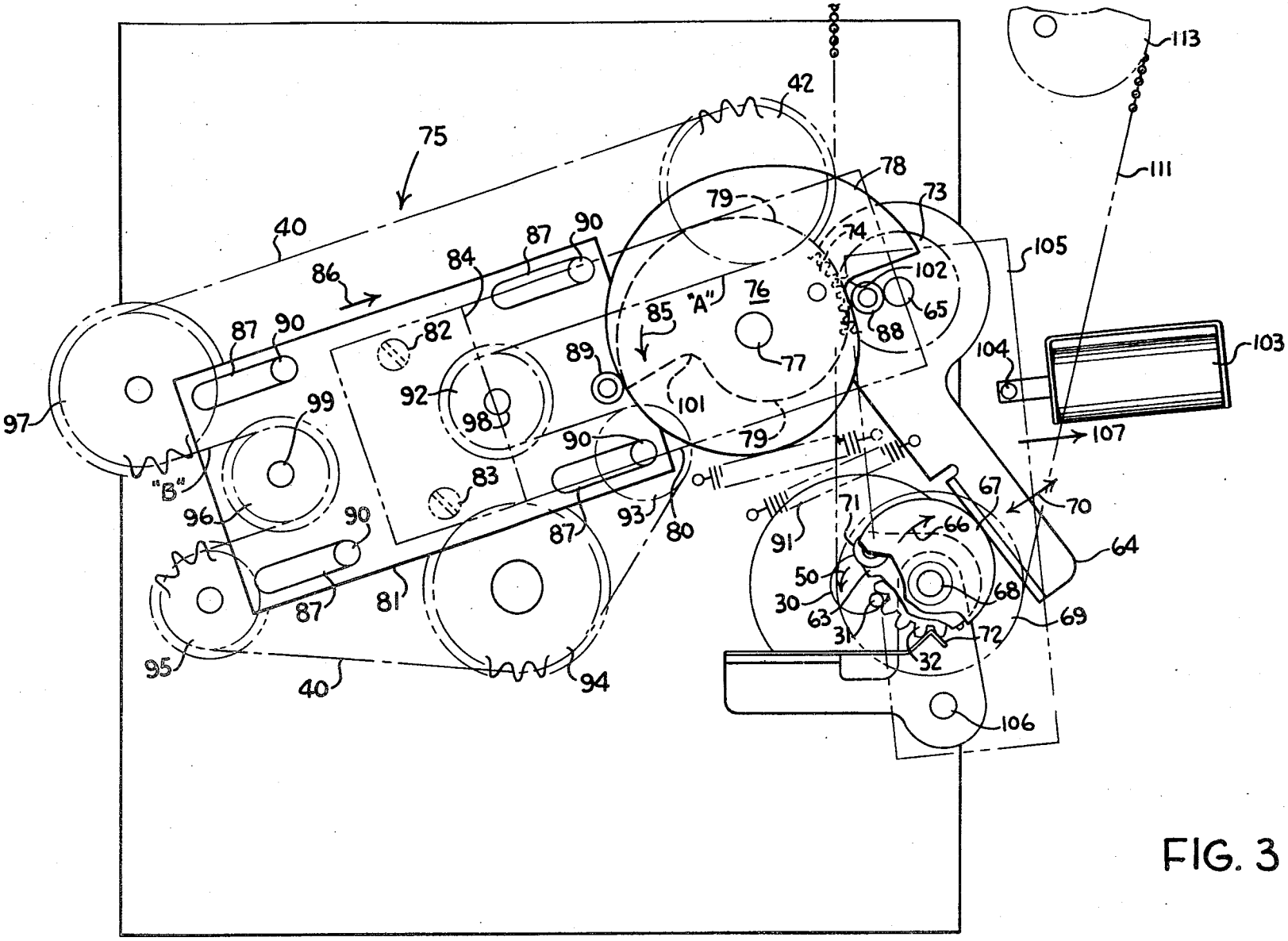
Figure 4:
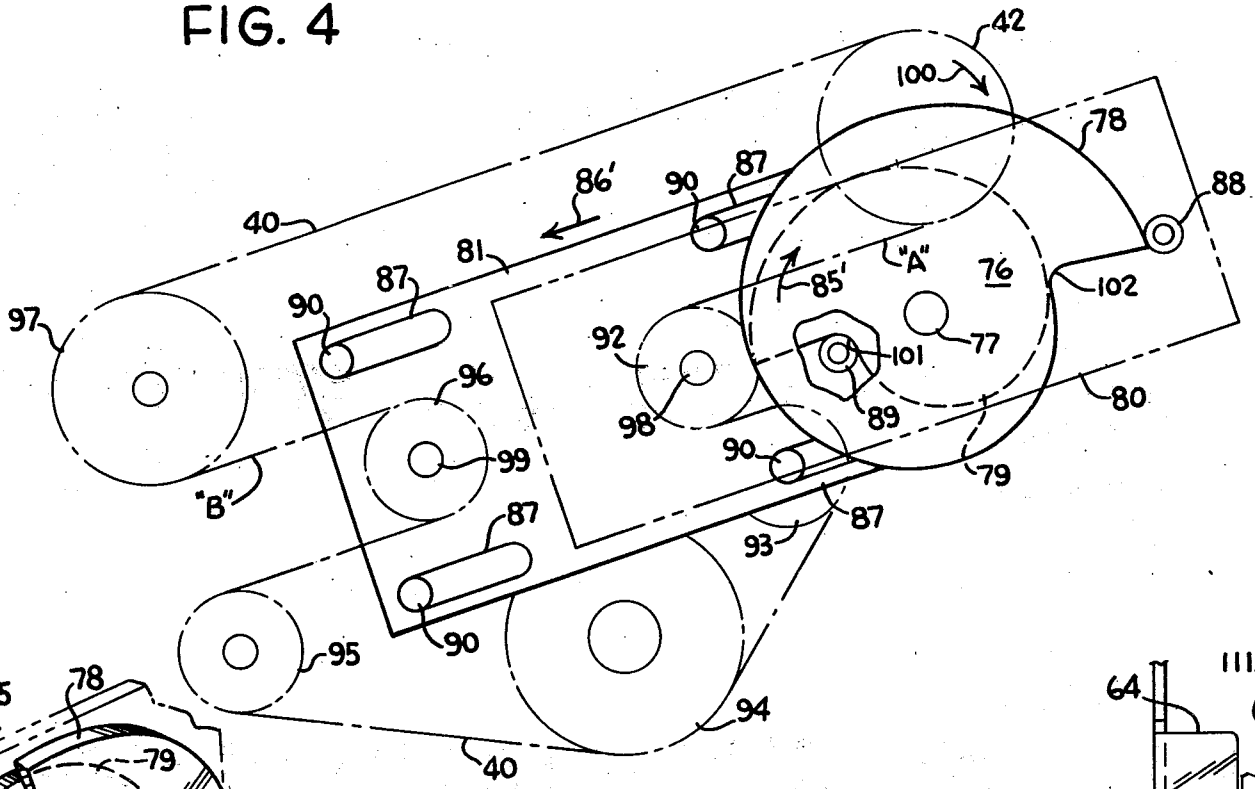
Figure 3C:
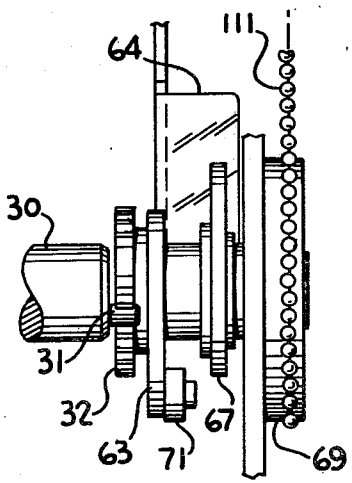
Figure 3B:
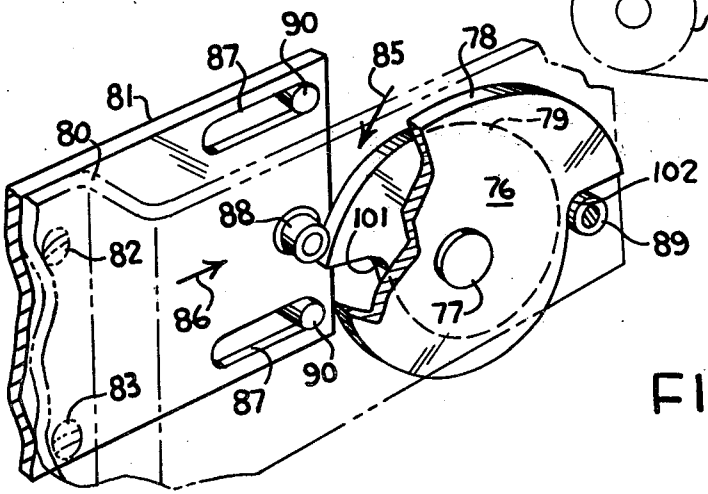

FIG. 3*a* is a plan view of a section of the paper thickness adjustment apparatus of the advancement mechanism of FIG. 3;

FIG. 3*b* is a partially cut-away perspective view of a portion of the advancement mechansim of FIG. 3;

FIG. 3*c* is a side view of a portion of the paper thickness adjustment apparatus of FIGS. 3 and 3*a*; and FIG. 4 is a partial plan cut-away view of FIG. 3 illustrating the advancement drive chain mechanism at the start of a collating cycle.

Unless otherwise shown or described, the rotary drum collator to which the present invention pertains operates and is structured as shown in application Ser. No. 410,900 filed Oct. 29, 1973; now U.S. Pat. No. 3,970,297.

Figure 1D:
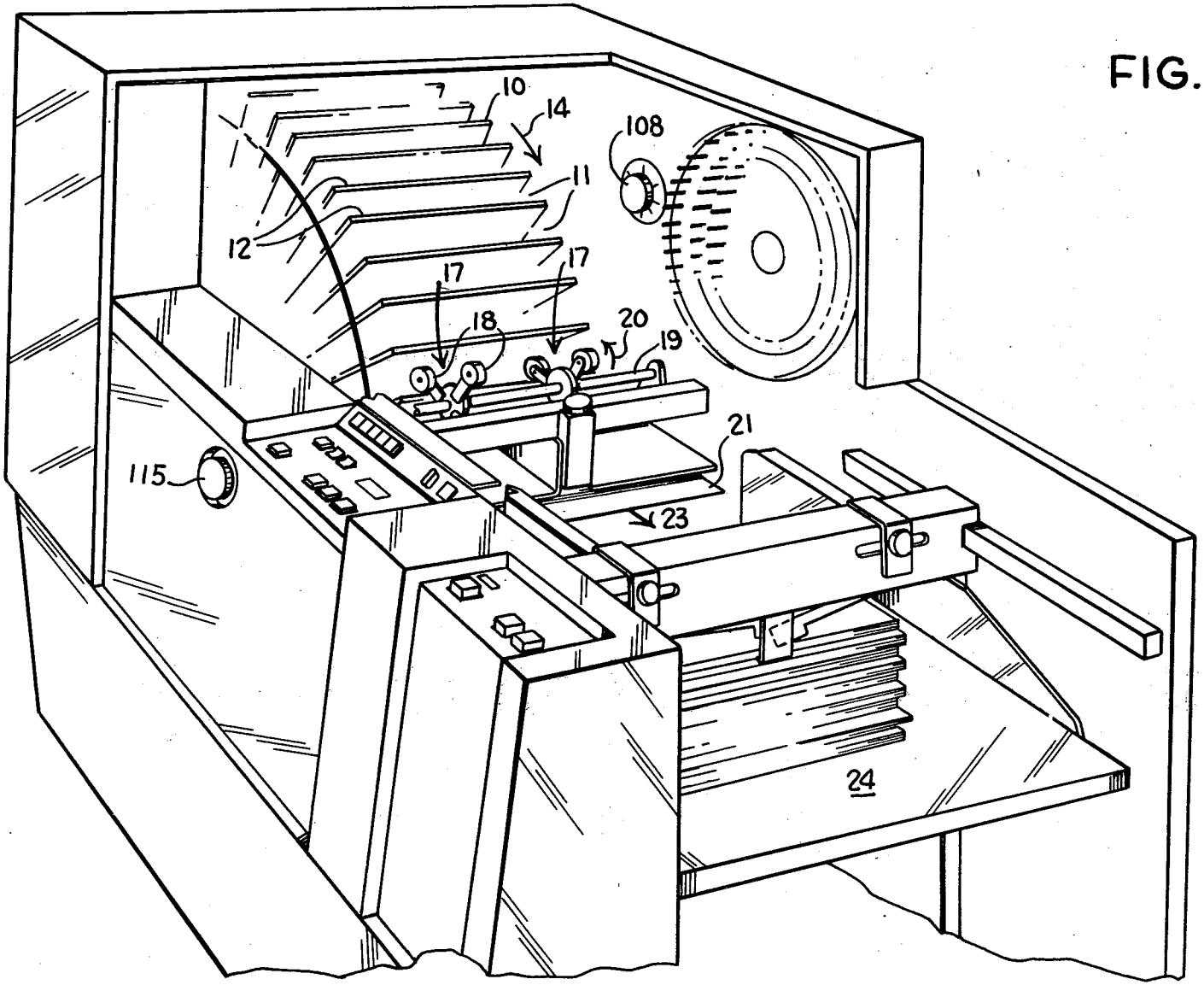

Now referring to FIGS. 1 and 1*d*, a schematic diagram and perspective view illustrates the rotary drum collator of the prior application, Ser. No. 410,900; filed Oct. 29, 1973 now U.S. Pat. No. 3,970,297.

A collating drum 10 contains pockets 11 having supporting trays 12. The supporting trays carry stacks of sheets 13, that are to be collated. The drum 10 is mounted for rotation (arrow 14) about center shaft 15, that is supported by frame 16.

The drum 10 is rotatively synchronized with a rotating set 17 of friction rollers 18 (spider). The friction wheels 18 are mounted to a common shaft 19, that rotates (arrow 20) in an opposite direction to that of the drum. The friction wheels 18 are each swept into a pocket 11 of the drum to withdraw the top sheet from the stack 13. Each removed sheet 21 is swept to the bite of roller pairs 22. The rollers 22 eject the sheets (arrow 23) to a collating tray 24, where the sheets are formed into collated stacks.

The normal operation of this prior art collator is desinged for standard sheet thicknesses of approximately 0.005 inches (FIG. 1*a*). When standard sheets are used, each friction roller 18 will sweep into a drum pocket 11 along a contact line 25, and contact a first sheet 26 of the stack 13 about point 27.

In theory, after a full revolution of the collating drum, it will be observed that each roller 18 will have to drop to a new contact point 28 in order to contact the second sheet 29. Theoretically, each succeeding revolution of the drum 10 will likewise require a corresponding drop in the contact point of each friction roller 18, in order to pick up the subsequent sheet in the stack.

Thus, it will be seen, that in addition to timing the set 17 of the rollers with the drum 10, it is also required to advance the phase angle of shaft 19 of the roller set 17 with each revolution of the drum. This advancement provides the rollers 18 with a deepening contact point, so that subsequent sheets can be properly removed from the pockets 11.

In practice, however, the contact point is not so critical as to require a phase angle change every drum cycle. But as several sheets are removed from any one pocket, compensation becomes more desirable, if not absolutely necessary.

In other words, the system can absorb a certain degree of tolerance change, before the rollers 18 will no longer make contact with the stacks. In practice, the roller set 17 is phased once for approximately every 3 drum revolutions.

The roller set 17 (spider) is periodically advanced (not necessarily each drum cycle) to a new phase angle to adjust for the changing average depth of the stacks.

Figure 2:
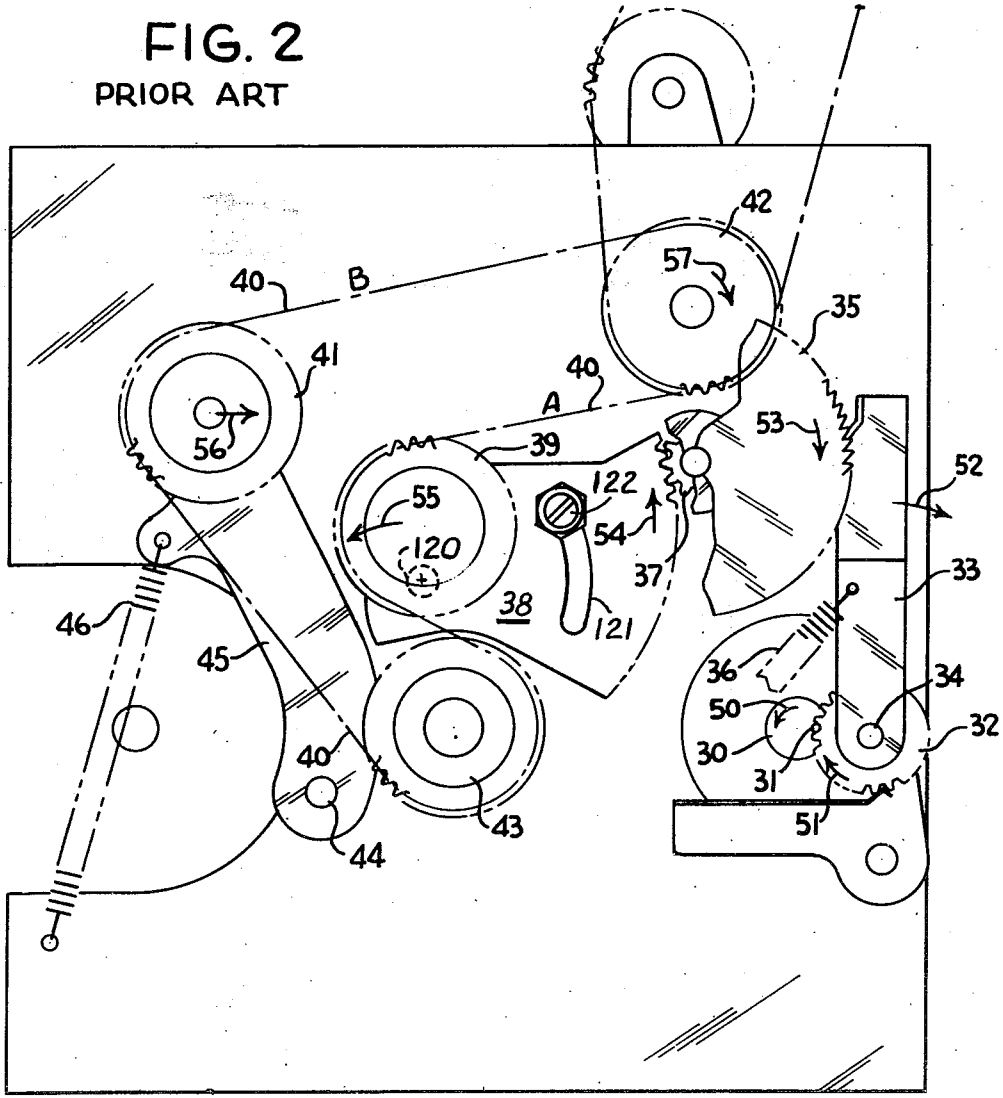
FIG. 2 PRIOR ART
FIG. 2 is a plan view of a prior art advancement mechanism for the collator of FIG. 1.

FIG. 2 shows the prior advancement mechanism for effecting the periodic phase change of the spider shaft 19.

A shaft 30 is operatively connected to the drum and rotates (arrow 50) in timed rotation. Shaft 30 carries a pin 31 which engages with gear 12. For each revolution of the shaft 30, pin 31 will move (arrow 51) gear 32 one tooth length. Pawl 33 is clutched to gear 32, and pivots (arrow 52) about shaft 34. For each movement of gear 32, pawl 33 pivots about shaft 34, thus allowing ratchet wheel 35 to advance (arrow 53) one tooth. Pawl 33 is return biased by means of spring 36.

Ratchet wheel 35 is clutched to the input pinion gear 37, which in turn moves (arrow 54) the gear segment 38. The segment gear is pivotable about a fixed gear 120, and is pivotably held to the frame of the mechanism by pin 122 acting within slot 121. As gear segment 38 is caused to move, the sprocket wheel 39 which is affixed to the segment gear 38, will be caused to move (arrow 55). The movement of the sprocket wheel 39 will in turn cause the span A of the drive chain 40 to increase in length. As will be seen, the drive chain 40 is supported by the four sprocket wheels 39, 41, 42 and 43.

When the span A of chain 40 is increased, it becomes necessary to decrease a corresponding working length of chain a like amount, in order to prevent the chain from snapping. This is accomplished by decreasing the length of span B. Sprocket wheel 41 is free to move in direction 56 (arrow), it being pivotable about shaft 44 via pivot arm 45. A biasing spring 46 connected to arm 45 puts tension on the chain system to provide the proper adjustment of the changing span lengths.

Chain 40 drives (rotates) the spider 17 via sprocket wheel 42. The periodic change of span lengths A and B causes the sprocket wheel 42 to periodically change its angle as shown by arrow 57. The angular change of the sprocket wheel 42 is transmitted to the spider (roller set) 17, and the spider is phased a like amount as that of the sprocket wheel 42.

The phase shifing (advancement) of the spider 17 is accomplished simultaneously with its rotation (arrow 20, FIG. 1). This is seen to be so, when it is remembered that the chain 40 is driven from the rotation of the drum 10, and the phase angle change (change of chain span lengths) is also effected via drum rotation.

Two problems have been found to exist with the prior drive chain system:

A. The spring 46 causes a constant tension on the chain, which equates itself into excessive wear on the sprocket wheels and chain. Also, when the collator was stopped within the middle of a run, e.g., to free a jam, the high torque applied through the segment gearing caused the whole advancement mechansim to reverse itself back to the starting position. This was undesirable, and it was decided that this condition could be prevented by redesigning the take-up sprocket wheel 41 to be mechanically united with sprocket wheel 39, so that the two sprocket wheels would have unitized movement.

B. There is a greater tolerance build-up than the system can tolerate, when sheets other than standard thickness are used. In other words, the phasing advancement between the spider 17 and the drum 10 could not accommodate the different depletion depth resulting from a change of sheet thickness, e.g., sheet other than approximately 0.005 inches. This problem can be more clearly observed with reference to FIGS. 1*b* and 1*c*.

FIG. 1*b* illustrates a stack of sheets 13 of nominal 0.010 inches in thickness supported upon a pocket tray 12. As described before, the friction roller 18 sweeps into the pocket 11 along contact line 25, and contacts the first sheet 26 of the stack at point 27.

Theoretically, the roller 18 should be made to drop one standard sheet thickness (0.005 inches) to point 28 after one drum cycle. In practice, the roller 18 is designed to drop three sheet thicknesses or 0.015 inches in every approximately 3 revolutions of the drum 10. However, for the purposes of illustration, it will be seen that after 1 cycle, a large disparity exists (0.005 inches) in the contact point 28 and the surface 60 of the next sheet 29. This disparity will naturally build-up with each succeeding cycle, until the situation is developed that roller 18 will not make contact with the next sheet. In other words, the continuous depletion of the sheets from the stack will eventually reach a greater depth with respect to the roller 18, than the machine was designed to handle. In this case, the roller 18 will not be able to pull the next sheet.

The converse is true with respect to sheets of thinner thickness, for example 0.0025 inches, as depicted in FIG. 1*c*. In this illustration, it will be seen that the contact point 28 will drop past the first and second sheets 26 and 29. In other words, the depletion of the stack is less than the phasing of the roller 18. In such a case, the tendency to withdraw doubles (more than one sheet) will start to manifest itself after several drum cycles.

In either of the situations depicted in FIGS. 1*b* and 1*c*, it is evident that some adjustment is required to accommodate for the differences in sheet thickness. Without this adjustment, the collator is severly limited in the type of booklets that can be provided.

In order to overcome the above drawback, the invention contemplates the use of a paper thickness adjustment and a new advancement drive chain mechanism that operates in reponse to this thickness adjustment. This improvement will be described with reference to FIGS. 3, 3*a*, 3*b*, 3*c* and 4.

In addition, the redesigned drive chain mechanism has eliminated the aforementioned wear problem by eliminating the spring-loaded condition. This improvement will be described with particular reference to FIGS. 3, 3*b* and 4.

Now with reference to FIG. 3, the new drive mechanism is shown having shaft 30, pin 31 and gear 32 as previously depicted in FIG. 2. These elements are structured and operate in essentially the same manner as before. The shaft 30 carries pin 31. Shaft 30 is driven (arrow 59) by the drum 10, and rotates gear 32 via pin 31. Gear 32 is integrally formed with a crank arm drive cam 63.

A crank arm 64 is pivotably mounted about shaft 65 (FIGS. 3 and 3*a*). Cam 63 engages with crank arm 64 (arrow 66) as the gear 32 is caused to rotate.

The throw (arrows 70) of the crank arm 64 is limited by a variable adjustment eccentric cam 67, that is rotatively mounted upon shaft 68 (FIGS. 3 and 3*a*). The crank arm drive cam 63 and gear 32 are rotatably mounted upon the same shaft 68 behind cam 67. This gear and cam combination is free to rotate upon shaft 68 as a unit, independent of the eccentric cam 67. The eccentric cam 67 is not in driving rotation, but is adjustable to different rotative positions. This is accomplished by turning sprocket wheel 69, which is integrally attached to cam 67 (FIG. 3*a*).

The positioning of the sprocket wheel 69 causes the eccentric cam 67 to assume a new rotative position. This results in lowering or raising the crank arm 64, which is biased against cam 67 by spring 91. Thus, when the drive cam 63 engages the crank arm 64 the crank arm 64 will lift from cam 67 and have a greater or lesser throw distance depending upon the height adjustment of eccentric cam 67.

The drive cam 63 is seen to have a roller 71 on its crank engaging end. This roller 71 reduces the friction of the engaging elements.

A leaf spring 72 acts as a detent for gear 32.

An input gear 73 is one-way clutched (not shown) to the crank arm 64 about the shaft 65. The one-way clutch translates the cranking motion of the crank arm 64 into rotation of gear 73. The drive chain system 75 comprises a chain 40 and a sprocket wheel 42 as in the previous drive system shown in FIG. 2. Sprocket wheel 42 periodically changes the phase angle set 17 (spider) as before. Again, two corresponding working (select) lengths of the drive chain 40 are simultaneously increased and decreased a like amount to change the phase angle of sprocket wheel 42.

The input gear 73 meshes with gear 74, which is integrally attached to a conjugate cam 76 via shaft 77. Cam 76 has two surfaces 78 and 79, respectively, as illustrated in FIG. 3b. Surface 78 drives cam follower 88, and surface 79 drives cam follower 89, respectively. Cam follower 88 is a roller that is rotatively mounted to plate 80. Cam follower 89 is a roller that is rotatively mounted to plate 81. Plates 80 and 81 are secured together by screw fasteners 82 and 83. Plate 81 is disposed below the cam 76, while plate 80 has a bend 84 (FIG. 3) allowing it to fit over the top of cam 76. The plates sandwich the cam between themselves (See FIG. 3*b*).

Cam followers 88 and 89 are uniformly displaced in unison as the cam 76 is rotated (arrow 85). This causes attached plates 80 and 81 to move in direction 86 (FIGS. 3 and 3b). The movement of the plates is made possible by means of the four corner slots 87 disposed in plate 81. Pins 90 are disposed in slots 87, and support and guide plate 80 for movement.

The chain 40 is supported by seven sprocket wheels 42, 92, 93, 94, 95, 96 and 97, respectively. Sprocket wheels 92 and 96 are slidably movable wheels of the drive chain system, and provide the change of working lengths A and B of the chain. This provides the phase advancement for sprocket wheel 42. Sprocket wheels 92 and 96 slidably movable, because they are rotatively supported upon the slidably movable plate 81, by means of spindles 98 and 99, respectively. The sprocket wheels 92 and 96 will move in unison as the plate 81 is caused to move.

Working span lengths A and B of the chain 40 are now defined as the chain distances between sprocket wheels 42 and 93; and sprocket wheels 95 and 97, respectively.

FIGS. 3 and 4 depict the plates 80 and 81 in their extreme travel positions. FIG. 4 shows the chain drive at the beginning of its advancement. Rotation of cam 76 in direction 85' will cause plates 80 and 81, and hence, sprocket wheels 92 and 96, to move to the left as shown by arrow 86'. This is seen to be so, because cam follower 89 will "ride-up" on surface 89, and cam follower 88 will simultaneously "ride-down" upon surface 78 of cam 76. The movement of the sprocket wheels 92 and 96 to the left (arrow 86') will cause span length A to increase, and span length B to decrease, respectively. This will result in advancing the phase angle of sprocket wheel 42 clockwise (arrow 100) as shown. As aforementioned, the advancement of wheel 42 is transmitted to the roller set 17 (spider) of FIG. 1.

FIG. 3 illustrates the final stage of the advancement mechanism 75. This is the position of the mechanism at the end of a complete collator run. As can be seen, a reverse rotation (arrow 85) of cam 76 will now be needed to return (arrow 86) the plates 80 and 81 to the initial position of FIG. 3. This is accomplished by turning a manually adjustable setting dial 115 (FIG. 1*a*) on a front panel of the collator, to a start position. Thus, the chain mechanism will be returned to its starting position (FIG. 4) at the end of the advancement cycle (FIG. 3). Naturally, this will also cause the spider 17 to return to its initial predetermined phase position via sprocket wheel 42.

In the event of a malfunction, or at the end of each collation run, the advancement of the chain drive can be disconnected by means of solenoid 103 (FIG. 3). Solenoid 103 is connected via pin 104 to swing plate 105. Plate 105 is pivotably mounted on spindle 106, and will be caused to swing outwardly (arrow 107) when solenoid 103 is actuated. The outward movement of plate 105 will cause the input gear 73 to disengage from camming gear 74. This will be observed to be true, since gear 73 and crank arm 64 are movably mounted upon the swing plate 105 via shaft 65. The disconnecting of the input gear 73 from camming gear 74 is necessary for reversing the cam 76, because of the one-way clutching of gear 73 about shaft 65. With gear 73 engaged to gear 74, cam 76 could not be reversed, because gear 73 cannot be reversed.

Solenoid 103 can be actuated by a limit switch (part of dial 115) which senses the end of a collation run.

The rotative position of bead wheel 69, and hence, the limiting position of cam 67 (FIGS. 3 and 3a), is controlled by a paper thickness adjustment dial 108 of FIGS. 1*d* and 3*a*. The dial 108 has graduations for selecting the proper paper thickness, for the paper that has been deposited in the pockets of drum 10 (FIG. 1). The selector dial 108 is rotatable (arrows 112) to a greater or lesser paper thickness setting. A bead wheel 109 is rotatively fixed to dial 108 via shaft 110, and rotates therewith. A bead chain 111 is connected between the beadmwheels 109 and 69, such that, any selective movement of the dial 108 and the bead wheel 109 will be communicated to the bead wheel 69, and hence, to cam 67. Thus, it will be seen, that the paper thickness selection of dial 108 will control the throw (arrows 70) of crank arm 64, which in turn prescribes a corresponding advancement for drive chain system 75.

An eccentric 113 provides the chain 111 with tension, so there will be no slippage between the bead wheels 69 and 109.

In summary, the advancement chain drive system 75 of FIGS. 3 and 4 will be seen to be free of any spring-loaded condition as depicted in FIG. 2 (spring element 46). The new camming arrangement (FIG. 3*b*) of the invention has provided the system with a positively controlled simultaneous increase and decrease of working span lengths of chain without the need for spring-loading chain 40, and has mechanically united the movable sprocket wheels 92 and 96.

The selector dial 108 will vary the advancement and phasing of the chain drive system 75 in response to the selected paper thickness.

Thus, it will be seen that the instant invention has met its stated objectives, and has provided an improved collator apparatus.

Of course, many changes of an obvious nature will present themselves to the skilled practitioner in this art.

Such changes are deemed to lie within the limits, spirit and scope of the invention as presented by the appended claims.

What is claimed is:

1. A rotary drum collator for forming sheet material into collations, said rotary drum collator comprising:

a rotatable drum having pockets for containing quantities of sheet material;

a withdrawing means disposed adjacent said drum and having at least one rotatable element for removing the sheet material from the pockets of said drum;

a drive chain mechanism operatively connected to said drum and said withstanding means for rotating said rotatable element in a phase relationship with respect to said drum to enter a pocket for removing sheet material therein, said drive chain mechanism comprising a drive chain, a pair of movably mounted rotatable sprocket wheels engageably connected to said drive chain, each sprocket wheel of said pair being movable for changing select operating lengths of said drive chain to change the phase between the rotatable element and the drum, and cam follower means, said cam follower means being operatively connected to said pair of sprocket wheels for causing the sprocket wheels to move; and advancing means operatively engageable with said drive chain mechanism including camming means for engaging with said cam follower means for moving the cam follower means and thereby moving each of said pair of sprocket wheels, whereby one select operating length of drive chain is increased while another select operating length of drive chain is simultaneously decreased, thereby advancing the phase relationship of said rotatable element of the withdrawing means with respect to said drum to accommodate for depletion of sheet material from the pockets of said drum.

2. A rotary drum collator for forming sheet material into collations, said rotary drum collator comprising:

a rotatable drum having pockets for containing quantities of sheet material;

a withdrawing means disposed adjacent said drum and having at least one rotatable element for entering said pockets in phase with the rotation of said drum for removing sheet material therefrom;

a drive mechanism operatively interconnecting said drum with said withdrawings means such that the rotatable element of the withdrawing means will rotate in an advancing phase relationship with respect to said drum so as to accommodate for depletion of sheet material from the pockets of said drum, said drive mechanism including a drive chain for rotating the rotatable element of said withdrawing means, said drive chain being operatively carried by a plurality of sprocket wheels, one or more of said sprocket wheels each being movably mounted so as to change select working lengths of said drive chain, and a pair of movably mounted cam followers that are operatively connected to the movably mounted sprocket wheels for moving each of said sprocket wheels; and a rotative camming means engageable with each of said pair of cam followers for causing said cam followers to move, and hence, moving each of said movably mounted sprocket wheels to change the select portions of the drive chain in order to advance the phase relationship of said rotatable element with respect to said drum.

3. A drive chain mechanism for a rotary drum collator having a rotatable withdrawing means for removing sheet material from pockets in rotatable drum, said withdrawing means having at least one rotatable element disposed adjacent said drum and rotatably driven in a phase relationship with respect to rotation of the drum to allow said element to properly enter the drum pockets for removing sheet material therefrom, said drive chain mechanism comprising:

a drive chain operatively supported by a plurality of rotatable sprocket wheels for rotating and advancing the phase relationship of said rotatable element with respect to the drum so as to accommodate for the depletion of sheet material from the pockets as said drum rotates, certain ones of the sprocket wheels of said drive chain mechanism being movably mounted so as to effect an operative change in select operating lengths of said drive chain;

cam follower means operatively connected to said movable sprocket wheels for moving the sprocket wheels to effect an operative change in said drive chain; and a camming means engageable with said cam follower means for displacing said cam follower means, so as to move the movably mounted sprocket wheels into effecting an operative change in the select operating lengths of the drive chain, whereby the drive chain will advance the phase relationship of said withdrawing means with respect to said drum.

4. The drive chain mechanism of claim 3, wherein one select operating length of the drive chain is operatively increased, while another select operating length of said drive chain is simultaneously operatively decreased a substantially equal amount.

5. The drive chain mechanism of claim 4, wherein one of said movably mounted sprocket wheels is slidably movable to increase a select operating length of drive chain, and another one of said movably mounted sprocket wheels is simultaneously slidably movable to decrease another select operating length of drive chain a like amount.

6. The drive chain mechanism of claim 5, wherein said cam follower means comprises first and second cam followers and wherein said camming means comprises a conjugate cam with a pair of camming surfaces, one camming surface engaging the first cam follower, and another camming surface engaging the second cam follower.

* * * * *

UNITED STATES PATENT AND TRADEMARK OFFICE

CERTIFICATE OF CORRECTION

PATENT NO. : 4,000,889

DATED : January 4, 1977

INVENTOR(S) : Hans C. Mol, et al.

It is certified that error appears in the above-identified patent and that said Letters Patent are hereby corrected as shown below:

Column 3, line 15, change "desinged" to --designed--;

line 53, change "12" to --32--;

line 61, change "gear segment" to --segment gear--;

line 64, change "gear segment" to --segment gear--.

Column 4, line 20, change "shifing" to --shifting--;

Column 5, line 15, change "severly" to --severely--.

Column 6, line 46, change "surface 89" to --surface 79--;

line 61, change "(FIG 1a)" to --(FIG 1d)--.

Column 7, line 29, change "beadmwheels" to --bead wheels--.

Column 8, Claim 1, line 10, change "withstanding" to -- withdrawing --.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*